United States Patent [19]

Haislet

[11] Patent Number: 4,887,421

[45] Date of Patent: Dec. 19, 1989

[54] APPARATUS AND PROCESS OF MANUFACTURING A METAL CORD

[75] Inventor: Gary A. Haislet, Asheboro, N.C.

[73] Assignee: The Goodyear Tire & Rubber Company, Akron, Ohio

[21] Appl. No.: 554,402

[22] Filed: Nov. 23, 1983

[51] Int. Cl.[4] ..... D01H 1/10; D01H 7/86; D01H 7/90

[52] U.S. Cl. ..... 57/58.54; 57/58.57; 57/58.65; 57/58.7; 57/58.83

[58] Field of Search ..... 57/58.57, 287, 58.63, 57/58.7, 58.83, 58.54, 58.55, 58.59, 58.65; 254/405

[56] References Cited

U.S. PATENT DOCUMENTS

| | | | |
|---|---|---|---|
| 1,164,919 | 12/1915 | Carlson et al. | 254/405 |
| 1,907,551 | 5/1933 | Kraft | 57/58.55 |
| 2,008,075 | 7/1935 | Kraft | 57/58.65 |
| 2,525,230 | 10/1950 | MacCreadie | 57/58.54 X |
| 2,546,977 | 4/1951 | Clary et al. | 57/58.57 X |
| 2,550,136 | 4/1951 | Clarkson | 57/58.7 X |
| 2,910,823 | 11/1959 | Bunch | 57/58.63 X |
| 3,793,819 | 2/1974 | Madalozzo et al. | 57/58.7 X |
| 4,332,131 | 6/1982 | Palsky et al. | 57/213 |

FOREIGN PATENT DOCUMENTS

| | | |
|---|---|---|
| 164065 | 12/1985 | European Pat. Off. . |
| 1510146 | 11/1970 | Fed. Rep. of Germany . |
| 2742612 | 4/1979 | Fed. Rep. of Germany . |
| 3215130 | 12/1982 | Fed. Rep. of Germany . |

*Primary Examiner*—Joseph J. Hall, III
*Attorney, Agent, or Firm*—T. P. Lewandowski

[57] ABSTRACT

A wire cord strander and method of making metal cord in a single step using single filaments which are not stranded is disclosed, particularly rotating payoffs are used to twist the filaments of the cord outer layers before forming and grooved pulleys are used to maintain cord shape and prevent feedback of cord twist.

8 Claims, 2 Drawing Sheets

APPARATUS AND PROCESS OF MANUFACTURING A METAL CORD

The present invention relates to apparatus and a method for manufacturing metal cords such as those used for reinforcing tires and more particularly to cord made in a single step process which cord is free of strands within the cord being made up of single filaments all twisted by the single step process and having a layered construction of three or more layers.

It is known to form metal cord of a single strand having three or more layers as a replacement for multi-strand cord and/or multi-layered cord formed with an alternate method of varying the direction of twist of each alternate layer. Both the stranding process and the alternating of direction of lay in creating a cord require a multiple step as opposed to single step process. The above known cord which has the advantages of a smaller diameter thus enabling calendering thickness to be reduced and improve fatigue resistance because of greater reinforcement per unit width of a calendered ply and generally line contact rather point to point contact between filaments as in stranded constructions particularly in use in tires can be made in a known manner wherein the wires are unwound by feed means and brought to means of regrouping and then to a strand laying device comprising an assembly twister which imparts to the assembly of wires a twist close to the nominal twist, the finished cord being collected on a receiving device wherein the unwinding tension of each single wire is so adjusted as to impart the twist efficiently at the twister and cause the strand laying twist to travel back efficiently to give a maximum twist at all points of the path of the cord.

The known apparatus for practicing the above known method includes means of regrouping the wires or filaments which can be distribution grids in accordance with the number of layers of wires in a cord wherein each wire passes through a hole in the grid. The strand laying device is advantageously a double twist device in which the strand laying spindle is of a conventional type. An assembly twister is located in front of the double twist device and internally of the device there are located an overtwister a straightener and a capstan in addition to the takeup spool for the cord.

The above method and apparatus teach that it is necessary that all wires should at the point of assembly be distributed in exactly the length which they are to have in the finished cord. This is the function of the assembly twister, which forms successive layers of wires and imparts to the cord a twist identical to its final twist. The assembly twister is a false twist operation with the true twist being imparted by the double twist strand laying device. The double twist strand laying device imparts the twist in two stages having incorporated therein means which facilitate the travelling back of the twist as far as the inlet of the strand laying spindle and further as far as the outlet of the draw off or assembly twister. It is further taught that in this way the untwisting of the assembly of wires downstream of the draw off twister is immediately compensated by the travelling back of the true twist imparted by the strand laying spindle.

Disadvantages of the above process are the high tendency for the occurrence of inversions and/or non-uniformities where the individual filaments are not in their close packed position and the use of feed rollers which slip under the wires operating at different speed than the travel speed of the wires to attempt to assure that the proper length of wire is fed into the assembly twister wherein the length of wire of the outer filaments varies from that of the inner filaments and the requirement of the addition of an assembly twister over and above the double twist strand laying device. Length control under reduced tension control is found to be very difficult to achieve and even more difficult to achieve under high tension. Use of high tensions allow higher operating speeds and therefore higher production through a given wire producing device.

The present invention overcomes the above disadvantages by the elimination of the feed rollers and assembly twister to thereby allow operation at higher tensions wherein there is created a catenary within a double twist strander.

The present invention is directed at a method and apparatus for forming in a single step operation a multiple filament cord of multiple layers which is free of strands within the cord and which cord has all the filaments twisted in the direction of lay of the cord.

The method includes the steps of applying a twist to the filaments in the outer layers of the cord in a direction opposite from that to be applied to all the filaments in the cord. A false twist is applied to all the filaments in the cord subsequent to applying the twist to the outer layer filaments, and the twist is set in all the filaments subsequent to the false twist operation to give the cord its final shape.

The above method is practiced using apparatus which includes a flyer with takeup spool, twister and straightener rolls, all internal to the flyer, including means for twisting the filaments in the outer layers of the cord, such as individual rotating payoffs, prior to entry into the flyer, and means for maintaining the gathered cross sectional shape of the cord, such as shaped grooves within guide pulleys, within the flyer prior to setting the final shape of the cord which prevents final cord laying twist from travelling back outside the flyer.

The above apparatus can further include rotating payoffs which have a two for one twist principle and guide pulley grooves which are shaped to accommodate the particular configuration of the cord being formed.

The method described above can further include the step of maintaining the intermediate cross sectional shape of the cord prior to applying the final twist to the cord as well as the step of preventing the final cord laying twist from travelling back beyond the final twist point.

Referring to the drawings

Figure 1:
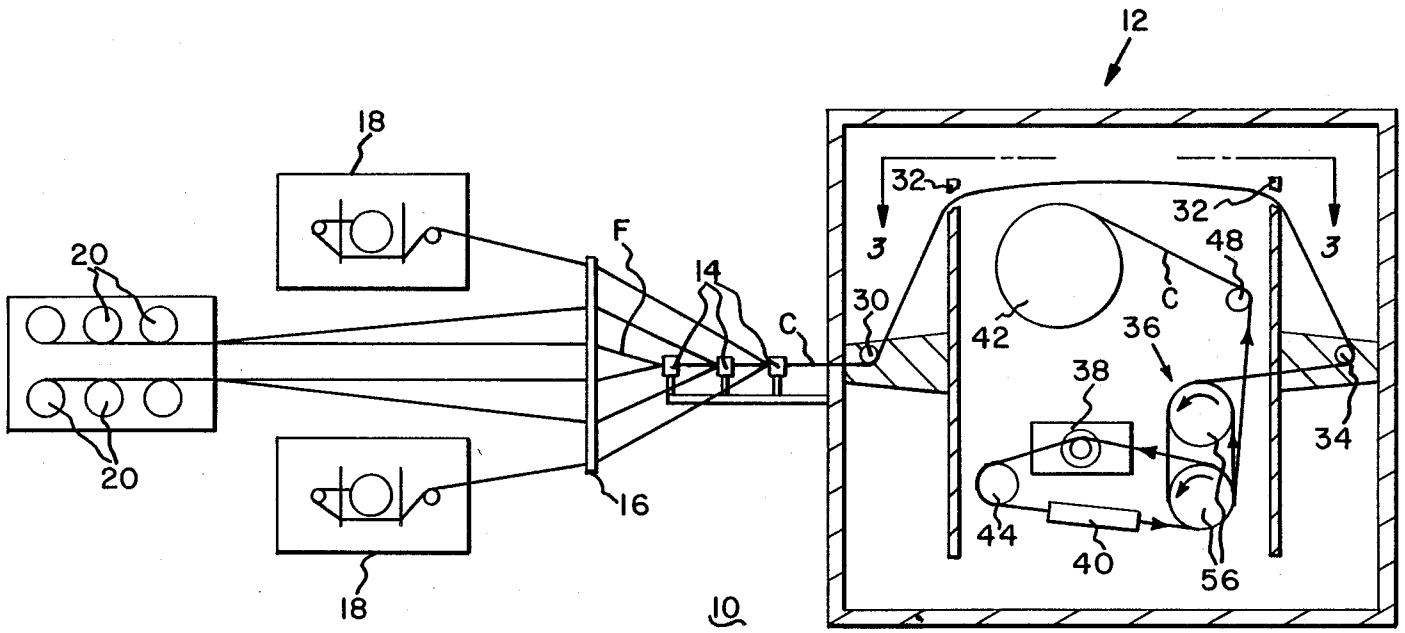
FIG. 1 is a schematic of a wire strander according to the present invention.

The strander can in FIG. 1 be seen as a double twist or two for one device 12 being fed by three forming dies 14 to which individual filaments or wires F being fed from an organization die plate 16 having properly located holes therein for passing the wires F to the forming dies 14 in a known manner. Rotating payoffs 18, which in this case are double twist or two for one devices, feed the outermost filaments F to the downstream forming dies 14 where the filaments F form the outer layer of a cord C. The inner filaments F are fed by a bank of stationary pay offs 20.

Figure 2:
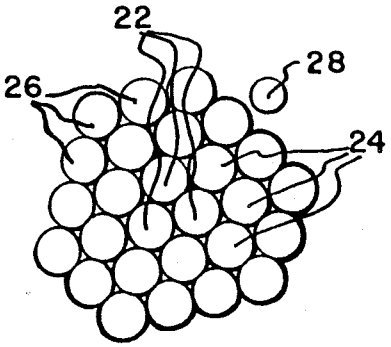
FIG. 2 is a cross sectional view of a cord in accordance with the method and apparatus of the present invention.

The cord C in its final form can be seen in cross section in FIG. 2. It has a core 22 of three filaments surrounded by nine filaments forming an intermediate layer 24 which in turn is surrounded by fifteen filaments forming the outer layer 26. In the preferred embodiment illustrated the cord C has a single wire wrap 28 which is generally wound around the cord C at a longer the lay of the cord C in a known manner not illustrated.

The core 22 and intermediate layer filaments F are each fed from an individual stationary payoff 20, FIG. 1, with the core filaments F being fed to the first of the forming dies 14 and the intermediate layer filaments F being fed to the second of the forming dies 14, respectively, after passing through the organization die plate 16. A rotating payoff 18 is provided for each outer layer filament F which filaments F are also then fed through the organization die plate 16 to the third of the forming dies 14. In this manner the filaments are fed in a layered construction as illustrated in FIG. 2. For alternate cord constructions having additional layers over and above those illustrated in FIG. 2 rotating payoffs for each additional outer layer filament would be provided.

The rotating payoffs are driven in a known manner (not illustrated) and can impart to the filament F thereon two turns for each turn of the pay off 18. Other rotating payoffs could be used, for example, a single rotary payoff as opposes the double payoff illustrated. For reasons to be discussed later the rotating payoffs 18 impart a twist to the filaments F of the outer layers of the cord C that is opposite in direction to that applied by the two for one device 12.

After leaving the forming dies 14 the cord C enters the two for one device 12 on its axis of rotation passing a guide pulley 30 over which it changes direction to pass in the form of a catenary through the flyers 32 and back over a guide pulley 34 to pass onto the inside of the flyers 32.

Mounted on a cradle (not illustrated) which is stationary and mounted within the flyers 32 in a known manner, are a drive capstan 36 which pulls the cord C into the flyers 32 at a speed synchronized with the rotational speed of the flyers 32 to provide the desired lay length of the final cord C, a false twister 38 used to exceed the elastic limit of the cord C to partially set the final desired mechanical properties of the cord C, two series of offset straightener rolls 40 used to straighten and set the final mechanical properties of the cord C and a cord takeup spool 42.

Figure 3:
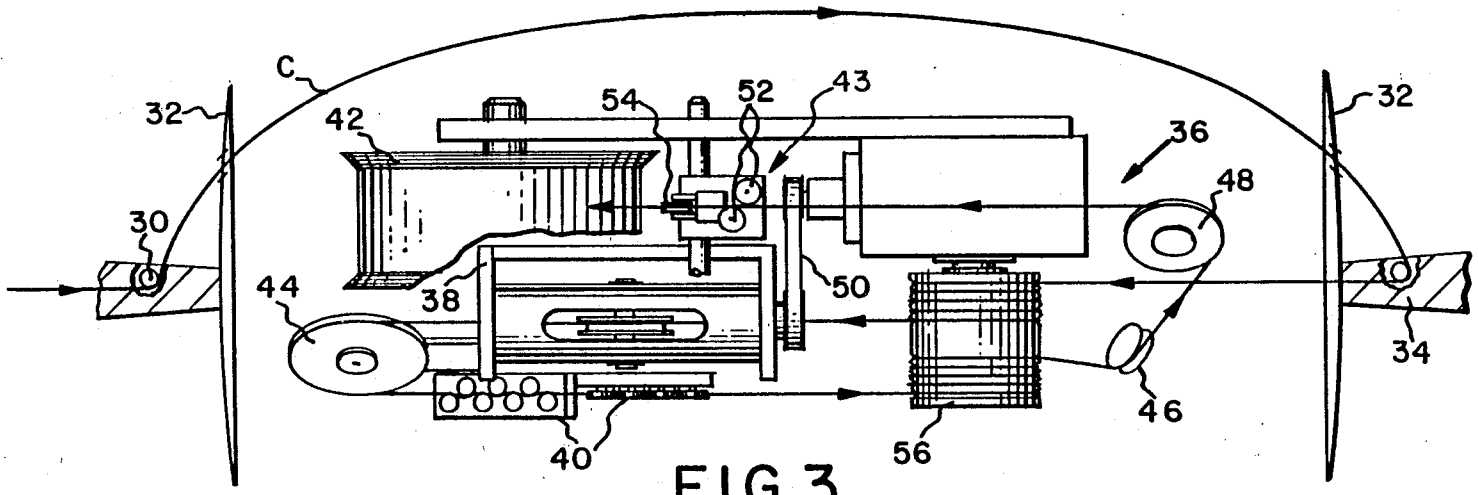
FIG. 3 is an actual view along line 3—3 of FIG. 1.

Referring to both FIGS. 1 and 3 an idler pulley 44 can be seen located between the false twister and straightener rolls 40. Directional pulleys 46 and 48 guide the cord C up to the takeup spool 42. In FIG. 3 the two series of straightener rolls 40 can be seen to be offset being located in planes which are at 90° to each other one being horizontal the other being vertical. The drive capstan 36 has two pulleys both of which are wrapped by the cord C and have grooves thereon for receiving the cord C. Further, a timing type drive belt 50 coordinates the speed of the drive capstan with the speed of the false twister 38.

The takeup spool 42 is fed by a traversing device 43 to lay the cord evenly on the takeup spool 42. The traversing device 43 includes two guide rollers 52 and a directional pulley 54.

The path that the cord C takes in reaching the takeup spool 42 is to span the flyers 32 upon leaving the guide pulley 30 until it returns to the inside of the flyers 32 after passing guide pulley 34. Upon entering the flyers 32 the cord C passes around the drive capstan grooved pulleys 56 with a multiple number of passes before wrapping a pulley of the false twister 38 and passing on to the idler pulley 44. The idler pulley 44 changes the direction of the cord C to cause it to pass between the two series of straightener rolls 40 after which is directed by directional pulleys 46 and 48 past the guide rollers 52 on the traverse device 43 mechanism and finally from directional pulley 54 onto the takeup spool 42.

The method practiced using the apparatus described above is to twist the filaments of the outermost strands of a cord in the direction opposite to that which the cord itself is to be twisted in setting the lay of the cord. The above capability is particularly significant in the method and apparatus of the disclosed embodiment illustrated in the drawings. To obtain a high efficiency for production of the type cord illustrated herein, a high speed two for one twist principle and apparatus is required. With the use of normal high tensile steel tire cord quality filaments and because the cord lay length is twice the final cord lay length immediately after the forming dies 14 where the filament lengths for each layer of the cord are set, excessively high stress levels would normally be applied to the outer filaments F during the false twisting operation due to filament length differences between the outer 26 and inner layers 24 of the cord. The initial twist given by the rotating payoffs to the outermost filaments 26 is a means to reduce the overall stress level applied to the third and possibly successive layers of the cord.

The filaments F, FIG. 1, are fed from the supply spools to the organization die plate 16 which has holes therein corresponding to the organization of the filaments F as they are to exist in the layers of the cord C illustrated in FIG. 2. Thus three filaments F are fed to the first of the forming dies 14 to form the core while nine filaments are fed to the second of the forming dies 14 to form the intermediate layer all twelve filaments being fed from stationary spools 20 while fifteen filaments are fed to the third of the forming dies 14 from individual rotating payoffs 18 to form the outer layer 26 of the cord C. As the partially formed cord C passes the guide pulley 30 a twist is imparted to it by virtue of rotation of the flyers 32 which twist travels back to the forming dies 14 to thereby encourage layering of the cord C at each of the individual forming dies 14.

Due to the high speed at which the flyers 32 along with guide pulley 30 rotate, the cord C leaving the guide pulley 30 takes the form of a catenary in bridging the flyers 32 before again engaging a guide pulley 34 where the cord C is turned on the axis of rotation of the flyers 32 to re-enter the flyers 32 by wrapping the capstan pulleys 56. A second and final twist is applied by the rotation of the flyers 32 at the point, where the cord C wraps the guide pulley 34. This twist is applied between the pulleys 34 and the capstan pulleys 56 but is not allowed to travel back beyond the guide pulley 34.

Two things occur at this point, first the cord C is given its final shape as illustrated by the cross section in FIG. 2. Secondly, the cord C back beyond the point of guide pulley 34 is not fully formed not having received the second and final twist whereby the outer filaments 26 in particular do not receive the high degree of torsional stress which creates high tensions tending to cause the filaments F to migrate from their designated positions. Further, as previously noted the initial opposite twist put into the outer filaments 26 by the rotating payoffs further offset the torsional stress normally introduced into the filaments F by the flyers 32 and this is true for the filaments F as they pass beyond the guide pulley 34 and receive the second and final twist as well as.

Once the final shape of the cord C has been formed having passed guide pulley 34 it is quickly passed over the capstan pulleys 56 into the false-twister 38 about the idler pulley 44 and into the series of straightener rolls 40 where the final shape of the cord C is set before being directed by directional pulleys 46 and 48 onto the takeup spool 42. Thus it is seen that as soon as the final form of the cord C takes shape upon entering the flyers 32 for the second time the false twister 38 can cause the cord filaments F to exceed their elastic limit and together with the straightener rolls 40 this allows the shape of the cord to be permanently set.

In addition to quickly setting the cord C once it has taken its final shape, a major disadvantage in high speed high tension stranders is overcome by preventing travel back of the second twist in the final cord through the flyer and onto the forming dies. The major disadvantage to the rolling back of the second twist to the forming dies is that many undesirable non-uniformities are introduced into the cord particularly where the cord has more than two layers of filaments, and where the desired final shape of the cord is not of the conventional round shape, in that the outer filaments are pushed out of their close packed compact position at the point where the second twist is forced back. These non-uniformities introduce localized high stress areas which result in reduced fatigue performance and increased fretting strength loss during tire life where the cord is used for example as a tire reinforcing cord.

Figure 4:
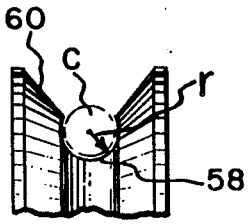
FIG. 4 is an enlarged fragmentary view of a guide pulley from FIG. 1.

Prevention of travel back of the second twist applied to the cord C results as noted above in a partially formed cord bridging the flyers 32. Because sufficiently high filament backed tensions are used to maintain the catenary, or wire bow, between the flyers 32 when the machine is operating at full speed, a means to maintain the integrity of the partially formed cord C when pulled over these pulleys has been found advantageous. Referring to FIG. 4 the guide pulleys 30 and 34 are provided with a groove 58 at the apex of their conical sides 60 having a radius which closely conforms the circumference of the inside of the groove 58 to the circumference of the outside of the cord C. Preferably a radius R of from a minimum of 0 to a maximum of 30 percent greater than one-half of the maximum diameter of the cord C being produced is used to form the groove 58. The groove has to have an opening a minimum of the maximum diameter of the cord and thus in forming the groove shape the groove 58 cannot be closed beyond an opening of this size. This opening will allow free passage of the cord C in and out of the pulley. By use of the groove 58 the cord C can be passed over the guide pulleys 30 and 34 without causing distortion of its cross sectional shape.

In accordance with the provisions of the patent statutes, the principle and mode of operation of the machine have been explained and what is considered to represent its best embodiment has been illustrated and described. It should, however, be understood that the invention may be practiced otherwise than as specifically illustrated and described without departing from its spirit or scope.

I claim:

1. A method of forming a multiple filament cord of multiple layers in a single step operation which cord is free of strands and having all the filaments twisted in the direction of lay of the cord comprising the steps of:

applying a twist to the outer layer filaments in a direction opposite from that to be applied to all the filaments in the cord;

applying a twist to all the filaments in the cord resulting in a reduction of stress in the outer filaments to more closely approximate that of the inner filaments;

thereafter applying a false twist to all the filaments in the cord; and setting the twist in all the filaments subsequent to the false twist operation to give the cord its final shape.

2. The method of claim 1 including the further step of maintaining the intermediate cross sectional shape of the cord prior to applying the final twist to the cord.

3. The method of claims 1 or 2 including the further step of preventing the cord final laying twist from travelling back beyond a final twist point.

4. Apparatus for forming in a single step operation a multiple filament cord of multiple layers which is free of strands within the cord and having all the filaments twisted in the direction of lay of the cord including a flyer with a take up spool, false twister and straightener rolls all internal to the flyer, comprising:

means for twisting the outer layer filaments of the cord prior to entry into the flyer; and means for maintaining the gathered cross-sectional shape of the cord within the flyer prior to setting the final shape of the cord which prevents the final cord laying twist from traveling back outside the flyer, 5. The apparatus of claim 4 wherein said means for twisting the filaments in the outer layers includes rotating payoffs.

6. The apparatus of claim 4 wherein said means for maintaining the gathered cross sectional shape of the cord includes guide pulleys, sloping inner sides on said pulleys, said pulleys having grooves in the bottom thereof generated by a single radius, located between and beneath the intersection of the inner sides of the pulleys.

7. Apparatus for forming in a single step operation a multiple filament cord of multiple layers which is free of strands within the cord and having all the filaments twisted in the direction of lay of the cord including a flyer with a take up spool, false twister and straightener rolls, all internal to the flyer, comprising:

non-rotating payoffs for feeding filaments to a flyer;

rotating payoffs for twisting outer layer filaments of the cord prior to entering the flyer;

a die plate for receiving the above filaments and organizing the filaments to coincide with their layered cord positions;

three forming dies for receiving filaments from the above die plate organized by layers, the first die receiving inside filaments, the second die receiving inside and intermediate filaments and the third die receiving inside, intermediate and outer layer filaments;

a first guide pulley rotating with the flyer and mounted thereon having a groove generated by a single radius, located between and beneath the intersection of the inner sides of the pulleys in the bottom thereof to maintain the intermediate shape of the cord; and a second guide pulley rotating with the flyer and mounted thereon having a groove generated by a single radius, located between and beneath the inter-section of the inner sides of the pulleys in the bottom thereof to maintain the final shape of the cord and prevent the cord laying twist from traveling back outside the flyer.

8. The apparatus claimed in claim 6 or 7 wherein said groove radius is 0to 30percent greater than one-half of the maximum diameter of the cord being produced.

* * * * *